US005289664A

United States Patent [19]

Rizza et al.

[11] Patent Number: 5,289,664

[45] Date of Patent: Mar. 1, 1994

[54] BACK DRAINAGE SYSTEM FOR EXTERIOR PANELS

[76] Inventors: Michael C. Rizza, 2863 Encina Camino, Walnut Creek, Calif. 94598; Maurice Lafayette, 3440 Enterprise Ave., Hayward, Calif. 94545

[21] Appl. No.: 916,052

[22] Filed: Jul. 17, 1992

[51] Int. Cl.[5] ..... E04B 1/41

[52] U.S. Cl. ..... 52/302.1; 52/490; 52/509

[58] Field of Search ..... 454/270, 271, 275, 276, 454/906; 52/97, 302, 209, 235, 533, 573, 478, 509, 490, 302.1, 303

[56] References Cited

U.S. PATENT DOCUMENTS

| | | | |
|---|---|---|---|
| 3,538,654 | 10/1970 | Gerola | 52/302.6 |
| 4,112,632 | 9/1978 | Simpson | 52/11 |
| 4,924,647 | 5/1990 | Drucker | 52/478 |
| 5,048,254 | 9/1991 | Merlau | 52/509 |

FOREIGN PATENT DOCUMENTS

| | | | |
|---|---|---|---|
| 799964 | 8/1958 | United Kingdom | 52/209 |

*Primary Examiner*—James L. Ridgill, Jr.
*Attorney, Agent, or Firm*—Townsend and Townsend Khourie and Crew

[57] ABSTRACT

In a wall panel wall system for a building with a plurality of wall panels, each wall panel having an exterior weather surface, an interior plenum exposed surface, and panel side edges extending the preselected thickness of the panels from the exterior weather surface to the interior plenum surface for abutment to similar said panels to form a continuous building exterior wall, and means affixed to the panels for supporting the panels from a structural member of the building. The panels as supported from the building abut to form at least one horizontal or diagonal joint at the side edges between the panels and at least one vertical joint between the panels. A caulking system is provided for the joints between the panels. The caulking system has an elastic gutter support member for forming a barrier between said horizontally or diagonally abutted panels. The gutter support member has a backing portion having wedged placement between said horizontally or diagonally abutted panels and an attached gutter portion extending along a bottom edge of said joint from the backing portion along a preselected thickness of said panels towards and beyond an interior plenum exposed surface of said panels to dispose beyond the plane of the plenum exposed portion of said panels an upwardly exposed gutter edge. The caulking system has at least one weep tube communicated to drain said gutter bottom at one end and extending along said vertical joint to and toward the weather exposed surface of said panels at the other end for discharging water from the interior of said gutter to the exterior weather exposed surface of said panels.

10 Claims, 5 Drawing Sheets

BACK DRAINAGE SYSTEM FOR EXTERIOR PANELS

This invention relates to a caulking apparatus and method for use with exterior building panels. Specifically, a panel caulking system is disclosed which drains the rear surface of such panel walls to ensure minimal penetration of moisture from the building exterior to the building interior.

BACKGROUND OF THE INVENTION

Buildings are frequently covered at the exterior by panels of stone, masonry, or even glass reinforced concrete. In such paneling, the panel typically includes a fastened supporting member. This supporting member extending from the panel is fastened to a structural member of the building.

Typically, the building panels are supported from the building so as to be juxtaposed one to another at their side edges so as to define narrow abutting juxtaposed edges between adjacent panels. Typically, the juxtaposed edges run either horizontally or diagonally and vertically. In order to render the building water proof, caulking of such panels is required at these joints between the panels.

Caulking for such panel is known. Typically, a backing rod is forced into the interstitial spatial interval defined at the groove between adjacent panels. Thereafter, a caulking compound is inserted to the joint to occupy the interval between the backing rod and the weather exposed portion of the joint. The caulking compound is chosen so that it is elastic. Further, the caulking compound typically adheres to the material of the panel—but not the backing rod. There hopefully results a substantial water tight seal between the building exterior and the building interior.

Unfortunately, such panel systems with their caulked joints are far from perfect. First, and because the outside of a building typically contains many lineal feet of such caulked joints, the joints contain intermittent and unpredictable leaks. These leaks can be in the caulking and panels as originally installed—or can develop as the building ages in exposure to the elements. Aging of caulked joints caused by thermal expansion and contraction at the caulked joints can aggravate the leakage problem.

Further, the building panels themselves can leak. Cracks in the panels can provide for the entry of moisture. Furthermore condensation can form on the inside walls of such panels—and can constitute a significant source of moisture.

Finally, the natural tendency of the walls to leak can be aggravated by both atmospheric air currents as well as heating, ventilation, and air conditioning interior of the building. For example, under many wind conditions, it is common for buildings to develop effective vacuums in their interior. The presence of such a vacuum aggravates the tendency of the building to leak at any given caulking or panel imperfection. Water from the exterior surface of the building can be literally "sucked" into the interior surface of the building along any panel or caulking imperfection.

In short, the exterior paneling system of any building will inevitably leak.

SUMMARY OF THE INVENTION

The present invention provides a sealing system for exterior wall panel joints such as masonry, stone, granite, and precast and metal panel walls. These wall panel joints are typically horizontal or diagonal in combination with substantially vertical joints between abutting panels forming the facings of buildings. The sealing system has a dual function. First, the sealing system conventionally provides a water tight joint between the abutted panels. Secondly, the sealing system traps and drains to the exterior of the wall from the interior of the wall any water which penetrates or condenses on the interior of the wall.

The sealing system includes a gutter support member including a drain gutter, a plurality of weep tubes for draining the drain gutter from the inside of the wall to the outside of the wall, and preferably a sealing member, such as a wet seal.

The gutter support member itself is typically made of an elastic material. Preferably, an extruded closed cell elastic foam is utilized; a rolled formed spring metal gutter support member may also be used. The gutter support member is placed longitudinally along the joint between horizontal or diagonal joints. This gutter support member is oversized with respect to the interstitial section defined between the abutting panels. When the gutter support member is shoved into the horizontal or diagonal interstitial interval between two abutted panels of the exterior wall, it creates a friction fit that holds the gutter support member in place between the panels.

This gutter support member includes two portions, a backing portion and an attached gutter portion. The backing portion has a vertical dimension sufficient to create a friction fit between the interior and exterior sides. The backing portion interior side functions as exterior drain gutter side wall for the drain gutter. The exterior side of the backing portion by itself can effect a water tight dry seal between two abutted panels. More usually, the exterior side of the backing portion functions as the backing rod for a wet seal. The wet seal binds to the abutted edges of the panels and creates an elastic and conformable waterproof joint between two abutted panels on the exterior side of the wall. When used as the backing for a wet seal, the backing portion is typically made of a non bonding material with respect to the material used in the wet seal.

The attached gutter portion of the gutter support member extends from the backing portion along the bottom surface of the panel joint to define the bottom surface of the drain gutter. This bottom surface of the drain gutter extends beyond that interior plane defined by the building panels to the plenum between the interior of the panels and the building. This gutter portion at its end remote from the backing portion has an upstanding vertically extending back leg which creates the interior wall of the gutter.

The reader will understand that depending on the thickness of exterior wall panels, the depth of the abutted interstitial joints between the panels may vary. Consequently, the gutter portion of the gutter support member must have a depth with respect to the backing member rear wall of the gutter to enable the rear wall member to extend behind the surface of the wall panels. Where this distance is extensive, added support for the cantilevered gutter is required. To give added support where the depth of the joints between panels is great, the gutter portion may include a vertical bar located midway between the backing portion and the rear vertical wall of the gutter. This vertical bar bears against the upper surface of the panel joint and is interrupted to allow the water to flow between the rear of the gutter and the front of the gutter. In this way, a weep tube communicated to any portion of the gutter can drain through the gutter supporting vertical bars.

The weep tubes are installed in the gutter portion of the gutter support member. Placement of the weep tubes is made at horizontal intervals. Spacing of the weep tubes along the gutter support member is made to enable registry of the weep tubes in a downward position at each downward vertical interstitial joint between panels.

At the bottom portion of each weep tube, the tube extends arcuately out and away toward the exterior surface of the panel wall. A piece of reticulated foam obstructs the weep tube, typically at its lower end exposed exteriorly of the wall. This obstructing reticulated foam allows water to flow out from the weep tube but prevents wind from blowing back up into the weep tube. The reticulated foam thus prevents moisture backup in the draining weep tubes and undesirable wind noise such as whistling in the weep tubes.

During installation, the installer disposes the gutter support member with the gutter towards the horizontal or diagonal joint with the back wall of the gutter extending upwardly. Thereafter, the installer shoves the gutter support member, gutter portion first, into the horizontal or diagonal interstitial joint between abutting panels. Such shoving continues until the backing member is all the way within but not through the interstitial interval between two abutted panels to the designed depth of the backing member with respect to the seal. The gutter dimension is selected so that the back-wall of the gutter protrudes beyond the plane defined by the back side of the wall panels.

It will be remembered that in the preferred embodiment, the drain gutter is used as the backing rod in a wet seal or caulking joint. In this case, the distance that the backing member is shoved in is specified by the sealant manufacturer who recommends the depth of the backing member with respect to the panel joint for use with a particular wet sealant for that panel joint. It will therefore be understood that this recommended depth will control the cross sectional dimension of the rear gutter wall with respect to the backing member.

During the installation of the gutter support member, the gutter portion will typically collapse during passage through the interstitial interval as it is being shoved into place. Because this member is sufficiently elastic, it will pop free in an erect moisture catching disposition as the backing member is forced to its specified depth in the interstitial joint between the panels.

The weep tubes may be installed before or after the gutter support member is shoved in place. To install the weep tubes, the installer pokes weep tube holes in the gutter portion between the backing member and the upwardly extending rear gutter wall. These weep tube holes are poked in registry with the downward vertical interstitial joints formed between two panels. The poked weep tube holes are typically smaller than the weep tube exterior diameters so that the weep tubes will force fit to the drain gutter with a water tight seal. A conventional adhesive or sealant can be used to secure the weep tubes in place. The portion of the weep tubes extending below the gutter support member and registered with the downward vertical interstitial joints are backed by conventional backing rods extending vertically of the vertical joints. This conventional backing is only interrupted sufficiently to allow passage of the weep tubes from the gutter to the exterior surface of the wall. The installer then applies the wet sealant with a caulking gun along both the horizontal or diagonal and vertical joints. The joints are covered entirely except over the draining ends of the weep tubes at the vertical joints.

Although the gutter support member is manufactured in continuous lengths, the lengths must be spliced as a practical matter. Thus, the installer will need to join the drain gutter in discrete lengths which together can form the required continuous drain gutter conforming to the length of the horizontal or diagonal joint. The installer will to this by cutting and adhering the profile of each gutter support member length with a compatible adhesive in the field. The gutter support member will have any required ends capped across the gutter.

DESCRIPTION OF THE PREFERRED EMBODIMENT

Figure 1:
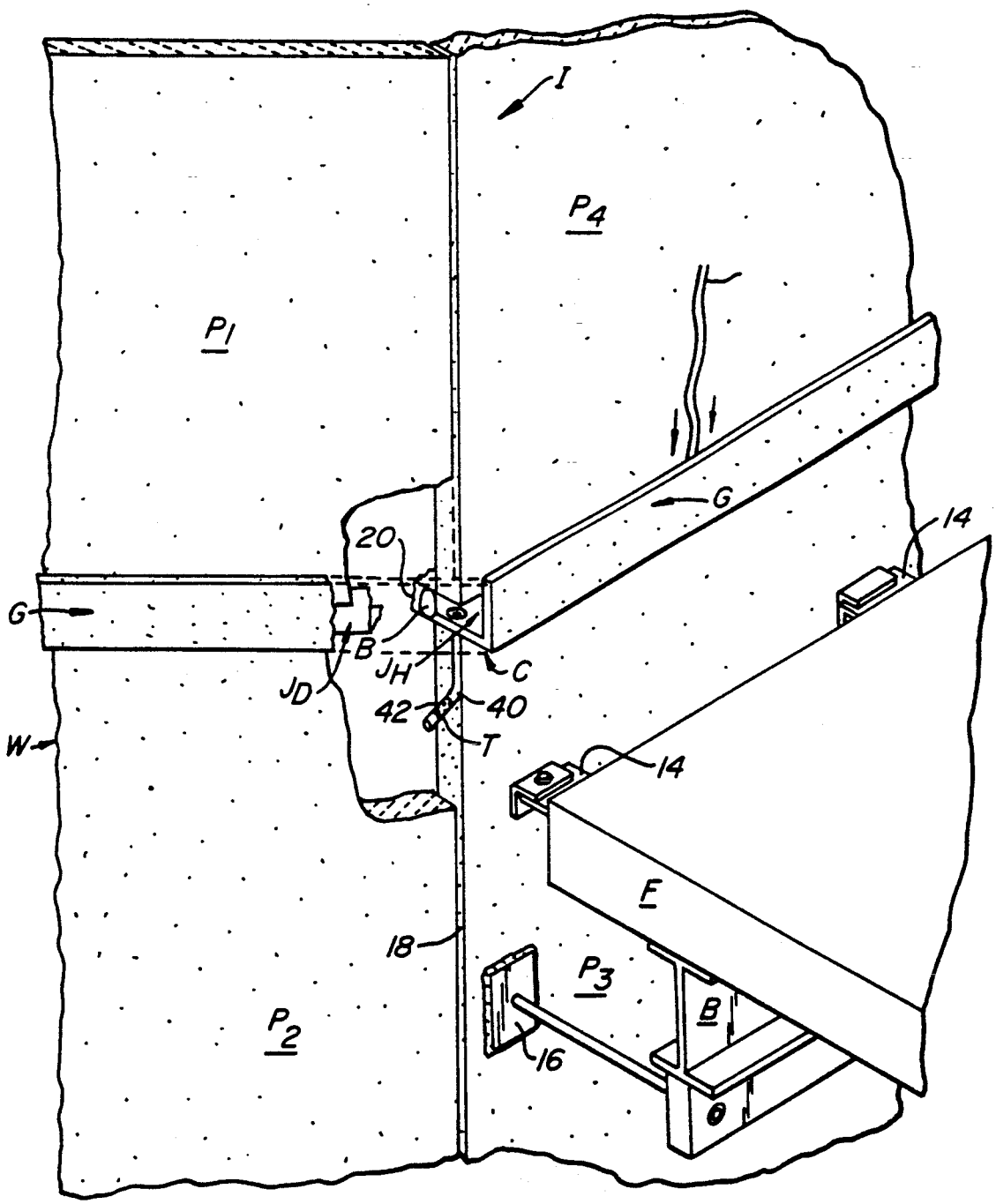
FIG. 1 is a perspective shown partially transparent to enable a view of abutted wall panels having the caulking system of this invention affixed thereto illustrating four abutted panels defining respective horizontal, diagonal and vertical joints having the caulking system of this invention installed to the joints between the panels.

With respect to FIG. i, the present invention is illustrated in perspective from the interior of a building. What is seen in the view of FIG. 1 is interior surface I of a panel system at the juncture of four panels, $P_1$, $P_2$, $P_3$ and $P_4$.

It is to be understood that each of the panels $P_1$–$P_4$ is conventionally attached to structural members of a building. In the present application only panel $P_3$ is illustrated having the conventional attachments 14 at the edge of floor F and attachment 16 from the bottom of beam B.

Panels $P_1$–$P_4$ are supported from the building from the inside and abutted at their respective edges 18. The invention herein provides a sealing system for exterior wall panel edge 18, whether such panels are constructed from masonry, stone, granite, and precast walls, such as those panels constructed from glass reinforce concrete (so-called "GFRC" panels).

Regarding these joints J between the respective panels, these wall panel joints J are typically horizontal joints $J_H$ or diagonal joints $J_D$ in combination with substantially vertical joints $J_V$ between abutting panels forming the facings of buildings.

The sealing system has a dual function. First, the sealing system conventionally provides a water tight joint between the abutted panels at the weather surface W. This is conventional. Secondly, the sealing system traps and drains to the exterior of the wall at weather surface W from the interior of the wall I an water which penetrates or condenses on the y interior of the wall.

The sealing system includes a gutter support member C including a drain gutter G, a plurality of weep tubes T for draining the drain gutter from the inside of the wall to the outside of the wall, and preferably a sealing member, such as a wet seal 20.

Figure 2:
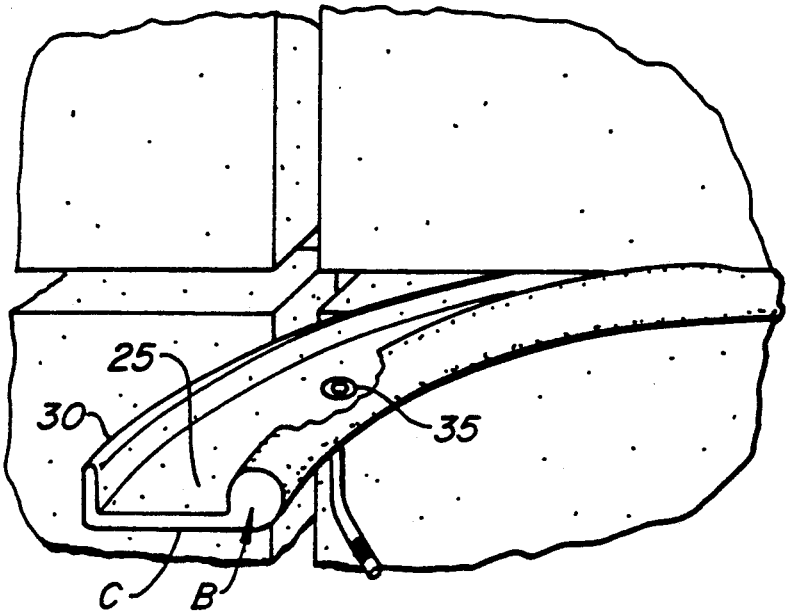
FIG. 2 is a side elevation perspective of four abutted panels illustrating the sequential insertion of a gutter support member between panels at their respective abutted edges with the schematic placement of a weep tube to the gutter bottom for the draining of the gutter being illustrated, it being realized that this weep tube installation can occur before or after gutter support member insertion.

The gutter support member C itself is typically made of an elastic material. Preferably, an extruded closed cell elastic blown foam is utilized; a bent spring metal gutter support member may also be used (See FIG. 7). Referring to FIG. 2, gutter support member C is placed longitudinally along the joint $J_H$ or $J_D$ between horizontal or diagonal joints. This gutter support member C has backing member B oversized with respect to the interstitial section defined between the abutting panels at joint $J_H$ or $J_D$. When the gutter support member C at backing member B is shoved into the horizontal or diagonal interstitial interval between two abutted panels of the exterior wall, backing member B creates a friction fit that holds the gutter support member C in place between the panels.

Gutter support member C includes two portions, backing portion B and an attached gutter portion G. The backing portion B has a vertical dimension sufficient to create a friction fit between the interior and exterior sides. The backing portion interior side functions as exterior drain gutter side wall for the drain gutter G (see also FIGS. 6A–6C). It is to be understood that the exterior side of the backing portion by itself can effect a water tight dry seal between two abutted panels. More usually, the exterior side of the backing portion B functions as the backing rod for wet seal 20. Wet seal 20 binds to the abutted edges 18 of the panels and creates an elastic and conformable waterproof joint between two abutted panels on the exterior side of the wall. When used as the backing for a wet seal, backing portion B is typically made of a non bonding material with respect to the material used in the wet seal.

The attached gutter portion G of the gutter support member C extends from the backing portion along the bottom surface of the panel joint to define the bottom surface 25 of the drain gutter G. This bottom surface of drain gutter G extends beyond that interior plane defined by the building panels to the plenum between the interior of the panels and the building. This gutter portion at its end remote from the backing portion has an upstanding: vertically extending back leg 30 which creates the interior side wall of the gutter.

Figure 4:
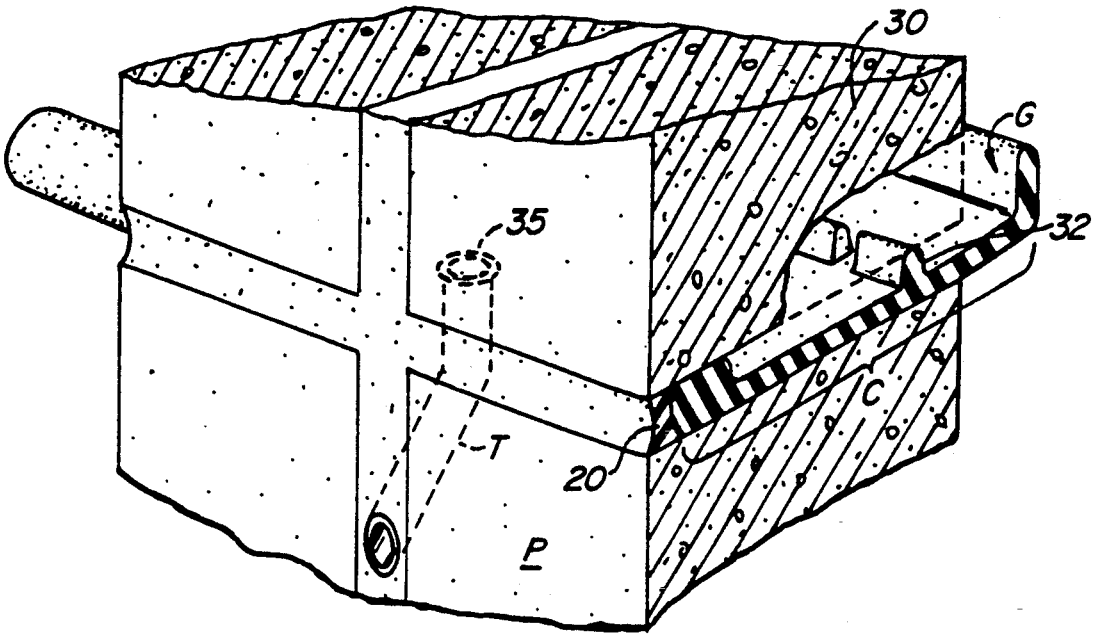
FIG. 4 illustrates in perspective the caulking system of this invention installed between precast panels having relatively thick abutted edges requiring modification of the gutter support member at the attached gutter portion with stops extending between the gutter bottom and the overlying abutted panel edge.
Figure 5:
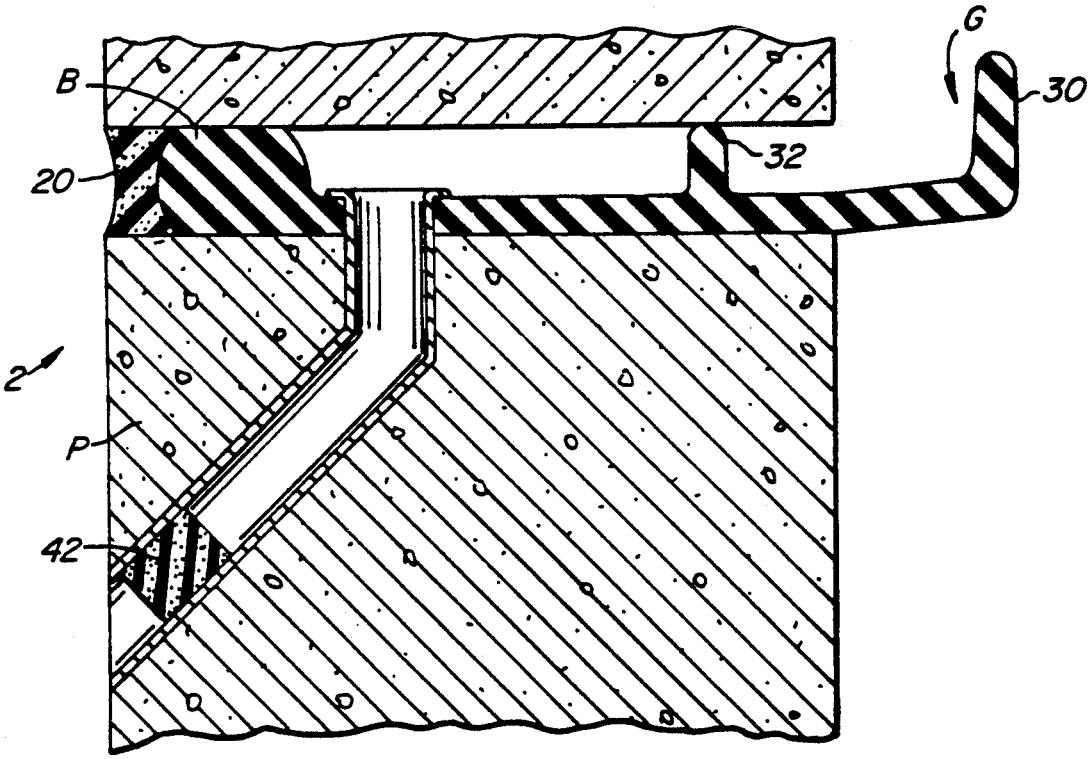
FIG. 5 is side elevation of FIG. 4 at the vertical joint illustrating in detail the entire caulking system connection.

The reader will understand that depending on the thickness of exterior wall panels, the depth of the abutted interstitial joints between the panels may vary. A comparison of FIGS. 2 and 3 with FIGS. 4 and 5 makes such a variation evident. Consequently, the gutter portion G of the gutter support member C must have a depth with respect to the backing member rear wall 30 of gutter G to enable rear wall 30 to extend behind the surface of the wall panels. Where this distance is extensive, added support for the cantilevered gutter is required. To give added support where the depth of the joints between panels is great, gutter portion G may include a vertical bar 32 located between the backing portion and the rear vertical wall of the gutter. This vertical bar bears against the upper surface of panel joint J and is interrupted to allow the water to flow between the rear of the gutter and the front of the gutter. In this way, weep tube T can communicate to any portion of the gutter G so as to drain the gutter G through the supporting vertical bars.

Weep tubes T are installed in the gutter portion G of gutter support member C. Placement of weep tubes T is made at horizontal intervals. Spacing of weep tubes T along gutter support member C is made to enable registry of weep tubes T in a downward position at each downward vertical interstitial joint $J_V$ between panels.

Weep tubes B normally include a belled or flanged upper end 35. The function of flanged upper end 35 is to enable weep tubes T to fit flush with the bottom gutter portion G.

At the bottom portion of each weep tube T, the tube extends arcuately out and away toward the exterior surface of the panel wall at 40. A piece of reticulated foam 42 obstructs the weep tube, typically at its lower end exposed exteriorly of the wall. This obstructing reticulated foam allows water to flow out from the weep tube but prevents wind from blowing back up into the weep tube. The reticulated foam thus prevents moisture backup in the draining weep tubes and undesirable wind noise such as whistling in the weep tubes.

Referring further to FIG. 2, and during installation, the installer disposes the gutter support member C with the gutter portion G towards the horizontal or diagonal joint $J_H$ or $J_D$ with the back wall of the gutter extending upwardly. Thereafter, the installer shoves the gutter support member, gutter portion first, into the horizontal or diagonal interstitial joint between abutting panels. Such shoving continues until backing member B is all the way within but not through the interstitial interval between two abutted panels to the designed depth of the backing member with respect to the seal. The gutter G dimension is selected so that the back-wall 30 of the gutter protrudes beyond the plane defined by the back side of the wall panels at interior wall I.

It will be remembered that in the preferred embodiment, the backing member B is used as the backing rod in a wet seal or caulking joint 20. In this case, the distance that the backing member B is shoved in is specified by the sealant manufacturer who recommends the depth of the backing member with respect to the panel joint size for use with a particular wet sealant for that panel joint. It will therefore be understood that this recommended depth will control the cross sectional dimension of the gutter G with respect to the backing member.

During the installation of the gutter support member, the gutter portion G will typically collapse during passage through the interstitial interval as it is being shoved into place. Because this member is sufficiently elastic, it will pop free in an erect moisture catching disposition as the backing member is forced to its specified depth in the interstitial joint between the panels.

The weep tubes T may be installed before or after the gutter support member is shoved in place. To install the weep tubes, the installer pokes weep tube holes in the gutter portion G between the backing member and the upwardly extending rear gutter wall. These weep tube holes are poked in registry with the downward vertical interstitial joints formed between two panels. The poked weep tube holes are typically smaller than the weep tube exterior diameters so that the weep tubes will force fit to the drain gutter with a water tight seal. A conventional adhesive or sealant can be used to secure the weep tubes in place.

The portion of the weep tubes T extending below the gutter support member and registered with the downward vertical interstitial joints are backed by conventional backing rods 60 extending vertically of the vertical joints $J_V$. This conventional backing is only interrupted sufficiently to allow passage of the weep tubes from the gutter to the exterior surface of the wall.

Figure 3:
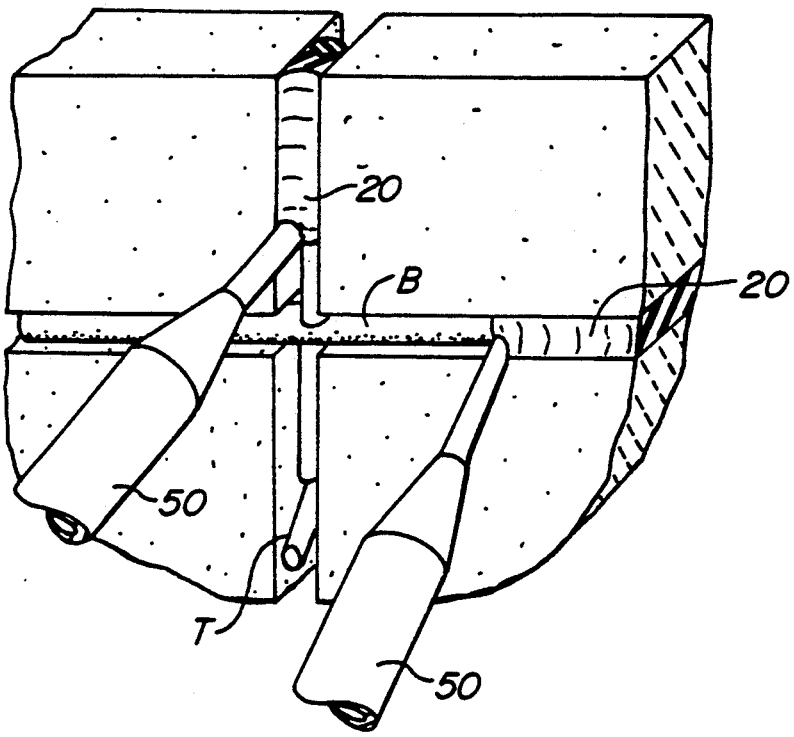
FIG. 3 illustrates the panels of FIG. 2 after the insertion of the gutter support member and weep tube to their respective intended depth illustrating the placement of the preferred wet seal over the gutter support member to form the completed sealing system of this invention.

Referring to FIG. 3, the installer then applies the wet sealant 20 with a caulking gun 50 along both the horizontal or diagonal and vertical joints. The joints are covered entirely except over the draining ends of the weep tubes at the vertical joints.

Although the gutter support member is manufactured in continuous lengths, the lengths must be spliced as a practical matter. Thus, the installer will need to join the drain gutter in discrete lengths which together can form the required continuous drain gutter conforming to the length of the horizontal or diagonal joint. The installer will to this by cutting and adhering the profile of each gutter support member length with a compatible adhesive in the field. The gutter support member will have any required ends capped across the gutter to form appropriate dams.

Figure 6A:
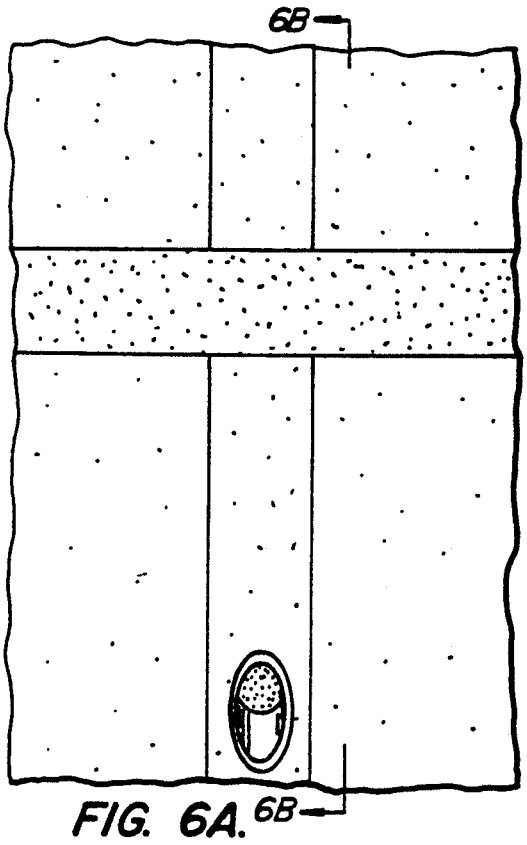
FIGS. 6A–6C are respective perspective views of a non-caulking compressible member which can be used in this drain system, this non-caulking compressible member commonly referred to as a "dry seal"
Figure 6B:
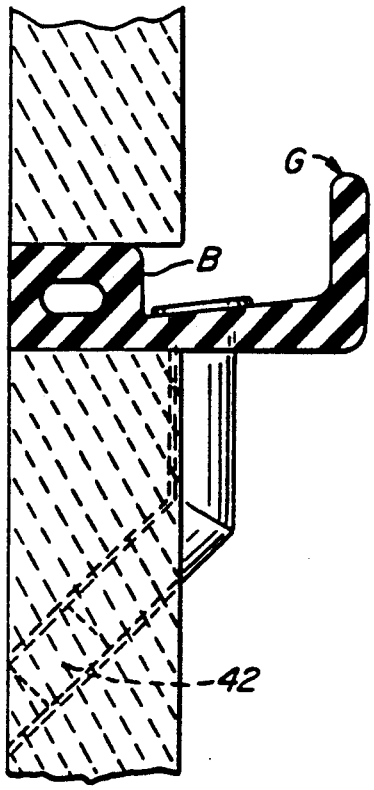
Figure 6C:
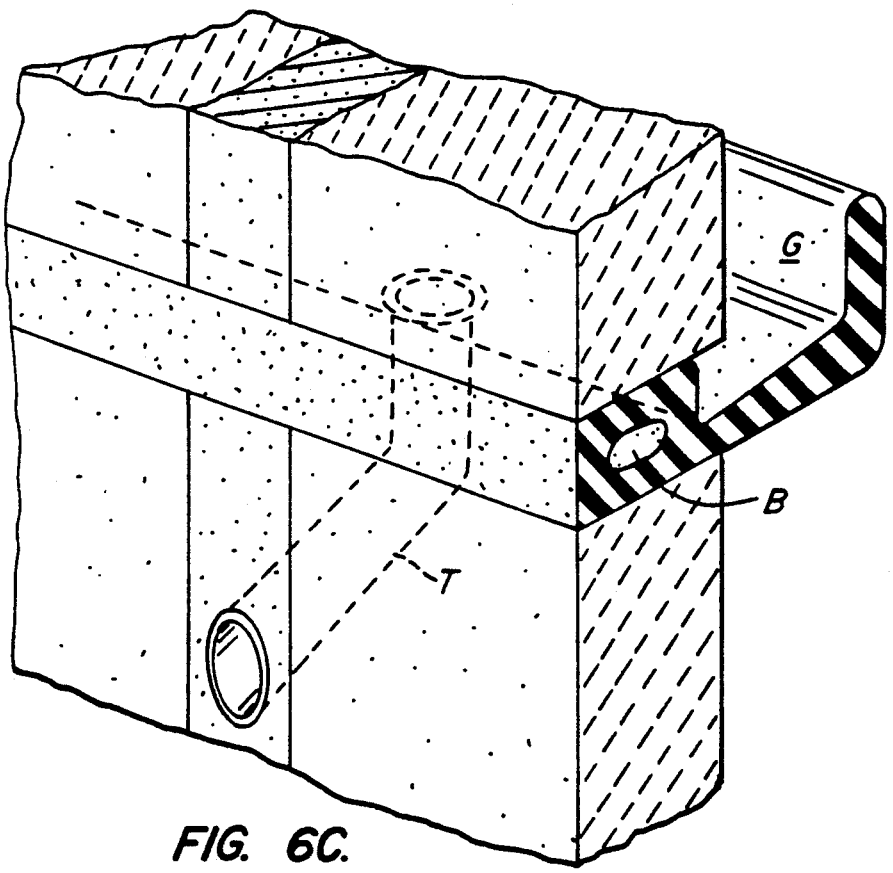

Referring to the front elevation, side elevation and perspective views of respective FIG. 6A, 6B and 6C, a compressible dry seal according to this invention is illustrated. A compressible material forms the dry seal caulking member including a gutter G with backing portion B. Backing portion exceeds in dimension the dimension between the panel edges; when inserted, this portion is compressed and alone forms the seal. Drain T is conventionally fastened to the bottom of gutter G and includes reticulated foam 42.

It will be understood, that installation is conventional. Insertion of the dry seal occurs with gutter G being inserted first followed by backing portion B. Unlike the previous embodiments, sealing or caulking material is not used.

Figure 7:
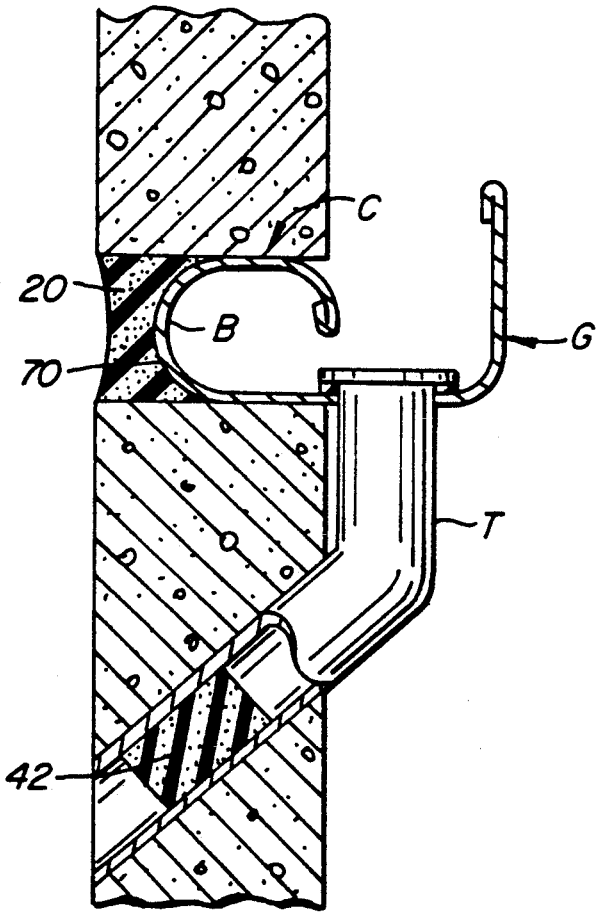
FIG. 7 is a perspective view of a gutter support member formed of metal which can be used in the caulking system of this invention.

Referring to FIG. 7, it will be understood that the gutter G of this invention can be made from other materials. In the example of FIG. 7, metal is utilized. Specifically gutter support member C is shown fabricated from a continuous metal strip having a bent backing portion B and a gutter portion G. where wet seal 20 is applied at the front surface of backing portion B, a bond breaking tape 70 is utilized.

What is claimed is:

1. In a wall panel wall system for a building including;

a plurality of wall panels having an exterior weather surface, an interior plenum exposed surface, and panel side edges extending the preselected thickness of said panels form said exterior weather surface to said interior plenum surface for abutment to similar said panels to form a continuous building exterior wall;

means affixed to said panels for supporting said panels from a structural member of said building;

said panels as supported from said building abutted to form at least one horizontal or diagonal joint at said side edges between said panels and at least one vertical joint between said panels;

a caulking system for said joints between said panels comprising in combination:

an elastic gutter support member for forming a barrier between said horizontally or diagonally abutted panels, said gutter support member including, a backing portion having wedged placement between said horizontally or diagonally abutted panels; and, a gutter portion attached to and supported from said backing portion, said gutter portion extending along a bottom edge of said joint from said backing portion along said preselected thickness of said panels towards and beyond said interior plenum exposed surface of said panels;

an upwardly exposed gutter edge attached to and supported from said gutter portion beyond the plane of the plenum exposed potion of said panels;

said gutter portion and said upwardly exposed gutter edge being elastically mounted with respect to said backing portion to enable insertion of said backing portion in wedged placement between said panels with elastic deformation of said gutter portion and said gutter edge during insertion between said panels; and, at least one weep tube communicated to drain said gutter bottom at one end and extending along said vertical joint to and toward the weather exposed surface of said panels at the other end for discharging water from the interior of said gutter to the exterior weather exposed surface of said panels.

2. The system of claim 1 and including:

a wet seal disposed in said abutted side edges between said panels at the side edges thereof between said weather exposed surface and said backing member.

3. The system of claim 1 and including:

a stop extending from the bottom of said gutter to an overlying abutted edge of a panel for maintaining said gutter along the bottom edge of said panel and supporting said protruding portion of said gutter extending beyond the plane of the plenum exposed surface of said wall.

4. The system of claim 1 and wherein:

said gutter support member is formed from an elastic closed cell foam.

5. The system of claim 1 and including:

barrier means in said weep tube between said gutter and said exterior weather exposed surface of said panels for inhibiting the entry of air into said tubes and permitting the exit of water from said tubes.

6. The caulking system of claim 1 and wherein:

said gutter portion extending beyond the plenum exposed surface of said panel wall has a vertical dimension exceeding the vertical dimension of said abutted interval between said panels.

7. In the wall panel system of claim 1 and wherein:

said elastic caulking member includes a dry seal.

8. In the wall panel system of claim 1 and wherein:

said elastic caulking member included bent non-corrosive metal.

9. A gutter support member for a wall panel wall system for a building including;

a plurality of wall panels having an exterior weather surface, an interior plenum exposed surface, and panel side edges extending the preselected thickness of said panels form said exterior weather surface to said interior plenum surface for abutment to similar said panels to form a continuous building exterior wall;

means affixed to said panels for supporting said panels from a structural member of said building;

said panels as supported from said building abutted to form at least one horizontal or diagonal joint at said side edges between said panels and at least one vertical joint between said panels;

a gutter support member comprising in combination:

an elongate elastic gutter support member for forming a barrier between said horizontally or diagonally abutted panels, said gutter support member including, a backing portion having wedged placement between said horizontally or diagonally abutted panels;

a gutter portion attached to and supported from said backing portion, said gutter portion extending along a bottom edge of said joint from said backing portion along said preselected thickness of said panels towards and beyond said interior plenum exposed surface of said panels;

an upwardly exposed gutter edge attached to and supported form said gutter portion beyond the plane of the plenum exposed portion of said panels;

said gutter portion and said upwardly exposed gutter edge being elastically mounted with respect to said backing portion to enable insertion of said backing portion in wedged placement between said panels with elastic deformation of said gutter portion and said gutter edge during insertion between said panels.

10. The gutter support member of claim 9 and including:

at least one weep tube communicated to drain said gutter bottom at one end and extending along said vertical joint to and toward the weather exposed surface of said panels at the other end for discharging water form the interior of said gutter to the exterior weather exposed surface of said panels.

* * * * *